United States Patent [19]

Joyce et al.

[11] 4,231,077

[45] Oct. 28, 1980

[54] LIGHT TOY

[76] Inventors: James E. Joyce; John P. Joyce, both of 878 Darien Cir., Rochester, Mich. 48063

[21] Appl. No.: 864,973

[22] Filed: Dec. 27, 1977

[51] Int. Cl.[3] ..... F21V 7/09

[52] U.S. Cl. ..... 362/32; 362/109; 362/202

[58] Field of Search ..... 340/321; 362/293, 102, 362/202, 806, 109, 32

[56] References Cited

U.S. PATENT DOCUMENTS

| | | | |
|---|---|---|---|
| 2,225,151 | 12/1940 | Borba | 362/102 |
| 2,242,981 | 5/1941 | Pedersen | 362/102 |
| 2,362,131 | 11/1944 | Haggart, Jr. | 362/293 |
| 2,434,741 | 1/1948 | Hefner et al. | 340/321 |
| 2,486,998 | 11/1949 | Szeklinski | 362/102 X |
| 2,549,103 | 4/1951 | Krauss | 362/205 X |
| 2,567,046 | 9/1951 | Anderson | 362/205 X |
| 2,586,723 | 2/1952 | Sakols | 362/109 X |
| 2,591,269 | 4/1952 | Lehoczki | 362/32 |
| 2,760,185 | 8/1956 | Held | 362/202 X |
| 2,823,300 | 2/1958 | Graubner | 340/321 |
| 3,877,171 | 4/1975 | Sloop et al. | 362/202 X |
| 4,064,429 | 12/1977 | Boehm | 362/102 X |
| 4,066,889 | 1/1978 | Hodgson | 362/205 X |

*Primary Examiner*—Peter A. Nelson
*Attorney, Agent, or Firm*—Krass & Young

[57] ABSTRACT

A light toy which may be used as a science fiction light ray or as a signalling, marking or illumination device is disclosed. A light source sends a beam of light into a nonopaque tube along its axis. The beam is reflected back into the tube by a reflective surface on the inner side of the cap at the other end. The light emitting device emanates a glow through the walls of the tube making the device highly visible. A kit for converting an ordinary flashlight into a light toy is also disclosed.

16 Claims, 11 Drawing Figures

LIGHT TOY

BACKGROUND OF THE INVENTION

Flashlight devices with elongated tubes extending beyond their lenses are known in the art. One such device employs an open-ended tube which permits the device to be used as a light wand and a beam source. The light of this beam can be used to illuminate other objects but does not greatly enhance the visibility of the device itself. If this beam could be somehow directed out through the walls of the tube, it would enhance the utility of the device for signalling or marking.

BRIEF SUMMARY OF THE INVENTION

The present invention provides an improved light emitting device which is intended for use as a toy, but which may readily be adapted to light wands for signalling or marking purposes. The device generally comprises a light source to produce a beam of light, such as a flashlight; a tube or light tunnel into which the beam of light is directed; and a cap on the end of the tube opposite the light source which reflects the light beam back into the interior of the light tube; so that the light entering the tube exits the device principally if not totally through the walls of the tube. The light tunnel becomes highly visible as the full output of the light source glows through its walls. The reflectivity and geometry of the interior surface of the end cap may be varied to result in different desired effects.

In specific embodiments of the invention, the light tunnel is attached to the light source by means of a short, open-ended post. This light tunnel post attaches at one end to the light source and at the other-end to the light tunnel. One specific example of the light tunnel post attaches to the light source by means of a flange which is held on to the light source by a lens cap. Another example has female screw threads which thread directly on to the light source.

The end of the light tunnel post opposite the light source attaches to the light tunnel. This attachment may be one of several different means. It may be a simple pressure fit where friction holds the tunnel in position. There may be interlocking circumferential grooves and ridges which engage each other. The two parts may be interlockingly threaded, or the light tunnel post may have longitudinal serrations which enhance the frictional strength of the joint.

Another device disclosed comprises a lens cap, a light tunnel post, a light tunnel and an end cap all molded from one piece of material. This greatly simplifies assembly of the completed device.

A method for converting an ordinary flashlight or other portable light source into a science fiction light ray toy or signalling device is also claimed.

DETAILED DESCRIPTION OF THE SPECIFIC EMBODIMENTS

Figure 1:
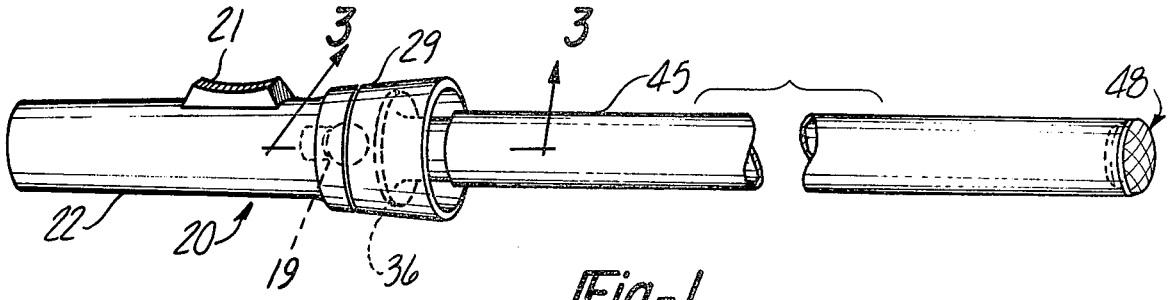
FIG. 1 is a perspective view of an assembled science fiction light ray toy.
Figure 2:
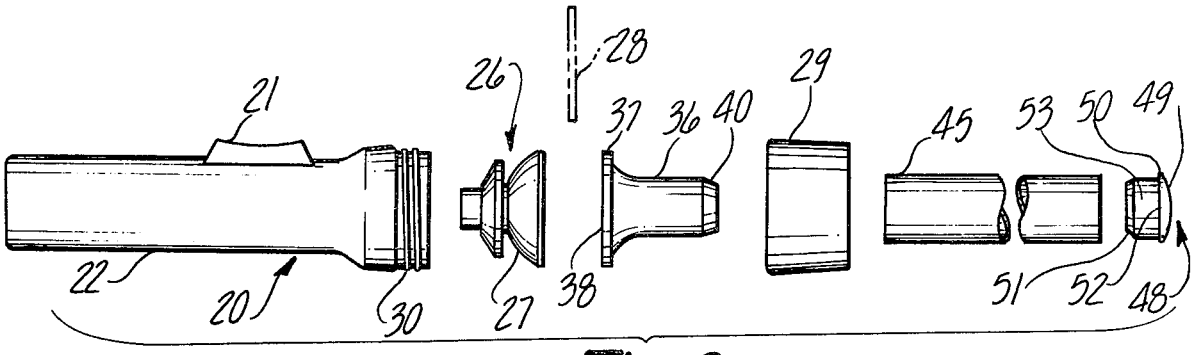
FIG. 2 is an exploded view of the device of FIG. 1.
Figure 3:
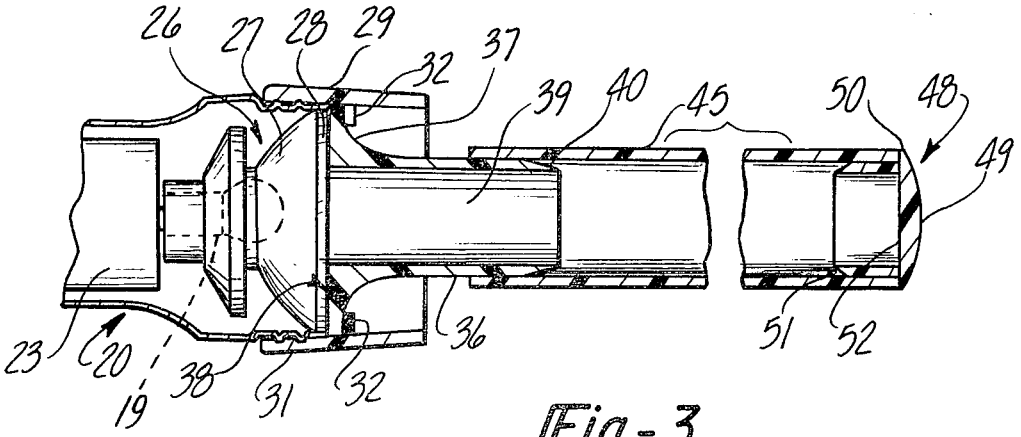
FIG. 3 is a sectional view taken on the line 3—3 of FIG. 1.

FIGS. 1, 2, and 3 show different views of one embodiment of this invention which can be used as a signalling device, a marking device, or a science fiction light ray toy. The numbers used in the description for any particular part are the same regardless of which figure is being discussed. The light source used in this particular embodiment is an ordinary flashlight 20. The switch 21 may be turned on or off to produce the beam of light. The power for the device is provided by batteries 23 which are in the body 22 of the flashlight.

The light emanates from a flashlight bulb 19 inside reflector assembly 26. The reflector assembly 26 contains a reflector bowl 27 which assures that all the light travels in one beam away from the body of the flashlight and through the light tunnel. Normally it has a highly reflective interior surface.

A lens such as flashlight lens 28 may be incorporated into the assembly though it is not necessary. Special effects are obtained by using different colored lenses and this is a simple and effective way to add color to the whole device.

The lens cap 29 is an internally threaded annular piece of material usually plastic which on a normal flashlight holds the reflector assembly and lens in position in the flashlight. The internal threads 31 engage the male threads 30 of the flashlight body. The internal circumferential flange 32 serves to hold a reflector 27 and lens 28 in position in a normal flashlight. In this specific example, the lens cap 29 also holds the light tunnel post 36 on to the flashlight body by engaging the circular flange 37 of the light tunnel post 36 and holding its flat face 38 against either the lens 28 or the reflector assembly 26.

The light tunnel post 36 is tubular in shape and has a hollow passage 39 through its center. There is a taper 40 at the end of the light tunnel post to facilitate the connecting of the light tunnel post to the light tunnel 45. The light tunnel post may be molded from transparent, translucent or opaque plastic or machined from the metal such as aluminum. Each of these variations will give a different effect to the light emitting device. The material in this specific embodiment is high density polyethylene which is white and translucent.

The light tunnel 45 in this specific embodiment is a one inch diameter extruded cylinder of low density polyethylene.

The cross-section of the light tunnel in this example is round but it could take other shapes. It could be a tube with triangular, square or other cross-sectional shape.

The light tunnel 45 is pressure fitted over the light tunnel post 36. A highly desirable structure for assuring a tight fit between the light tunnel and the light tunnel post is to use a light tunnel post with a smooth exterior surface and a diameter slightly larger than the internal diameter of the light tunnel. Then as the light tunnel is forced over the light tunnel post, the elastic force of the walls of the light tunnel serve to increase the frictional engagement between the two pieces.

Another benefit of this type of connection between the two pieces is that the connection is easily broken. If one desires to collapse the device into a smaller space, he need only disconnect it at this point to substantially shorten it. This will neither require the unscrewing of the lens cap nor the possible loss of the small parts inside the head of the flashlight.

A wall thickness of approximately 3/32nds of an inch means that the tube is highly resilient and will be able to stand much abuse. Particularly, children using it as a science fiction light ray will bump into objects with it. With this wall thickness, the tubing will be able to take a substantial amount of impact.

A reflective cap 48 fits into the opposite end of the light tunnel from the light source. The reflective cap 48 has an internal surface 52 and an external surface 49. In the preferred embodiment the internal surface 52 will be highly reflective. This reflective surface can be a thin layer of reflective material such as metal foil pasted on the internal surface. If the reflective cap were made from a shiny material, it could be merely a polished surface. Or a layer of reflective material could be plated on to the internal surface.

The neck of the cap 53 will have approximately the same external diameter as the light tunnel post so that it will form a tight friction joint with the light tunnel 45. It will also have a tapered end 51 to facilitate assembly. The diameter at 50 is the same as the external diameter of the light tunnel post to form a smooth joint.

Prior art light emitting devices do not include this reflective cap. The addition of this reflective cap increases light emitted through the walls of the light tunnel. Use as a marking or a signalling device is greatly enhanced by brighter light because the device can be seen over greater distances or through interfering substances such as smoke, haze or fog. The substantially brighter light emitted also makes it much more desirable as a light ray toy.

For use as a light ray toy, an ordinary flashlight 20 makes a good source of light. The body of the flashlight 20 with the switch 21 makes a convenient handle for the toy.

Other types of light sources could also be used depending on the characteristic of the light desired. Signalling and marking devices would give off a brighter light if regular AC current lamps were used instead of the flashlight bulb. In remote locations, where electricity is not available and batteries are impractical, a propane or kerosene flame might serve as a light source. Any source of light capable of forming a beam could be used.

Different and attractive effects can be achieved with this device by inserting different colors lenses 28 or by using light tunnel posts, light tunnels, and lens caps of different colors and opacities.

The light tunnel post light tunnel and reflective cap could also be used in a method for converting an ordinary flashlight into a light emitting device of this invention. The lens cap of the flashlight is simply unscrewed and the light tunnel post either placed over or substituted for the lens of the flashlight. One need only then fit the light tunnel and reflective cap on to the light tunnel post to manufacture a complete light emitting device.

The foregoing is a particularly desirable embodiment of this invention. However, many others are possible. Many variations of the connecting means between the light tunnel post and the light tunnel are possible.

Figure 4A:
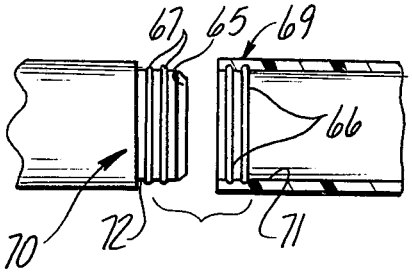
FIGS. 4*a, b* and *c* are three detailed views of fastening means used to enhance the frictional force holding a light tunnel on the external surface of a light tunnel post.

FIGS. 4*a, b* and *c* show three alternative means for attaching the light tunnel to the light tunnel post where the light tunnel post fits inside of the light tunnel. In FIG. 4*a* the outer surface 72 of the light tunnel post 70 contains two circumferential ridges 67. The internal surface 71 of the light tunnel 69 has two circumferential grooves 66 which mate and engage the circumferential ridges 67 of the light tunnel post 70 and improve the strength of this connection. A taper 65 in the light tunnel post aids in the assembly.

Figure 4B:
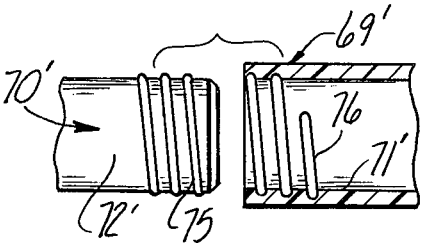

In FIG. 4*b* the light tunnel post 70' has male threads 75 on its external surface 72'. The light tunnel 69' has female threads 76 on its internal surface 71'. The male threads 75 engage the female threads 76 to form a tight connection between the two parts of the device.

Figure 4C:
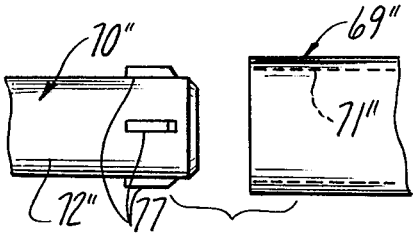

In FIG. 4*c* the external surface 72" of the light tunnel post 70" has spaced longitudinal serrations 77 which engage the smooth internal surface 71" of the light tunnel 69" to improve the frictional contact between the two parts.

Figure 5A:
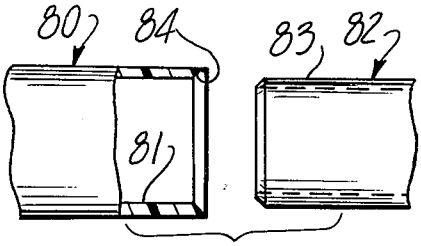
FIGS. 5*a, b* and *c* are three detailed views of fastening means where light tunnels fit inside light tunnel posts.

FIGS. 5*a, b* and *c* show a series of connections between a light tunnel post and a light tunnel where the light tunnel fits inside of the light tunnel post. In FIG. 5*a* the internal diameter of the light tunnel post 80 will be slightly smaller than the external diameter of the light tunnel 82. The internal surface 81 of the light tunnel post 80 is smooth and frictionally mates with the external surface 83 of the light tunnel 82. The reverse tapering 84 aids in the assembly of the device by guiding the light tunnel into the interior of the light tunnel post.

Figure 5B:
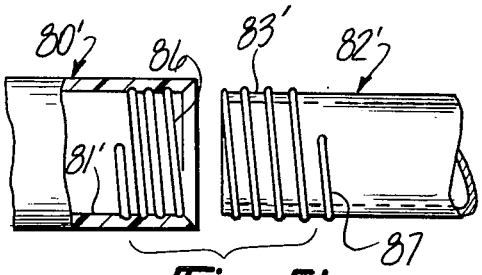

In FIG. 5*b* the internal surface 81' of the light tunnel post 80' has female threads 86. The external surface 83' of the light tunnel 82' has male threads 87 which engage the female threads 86 of the light tunnel post 80' to form a tight joint.

Figure 5C:
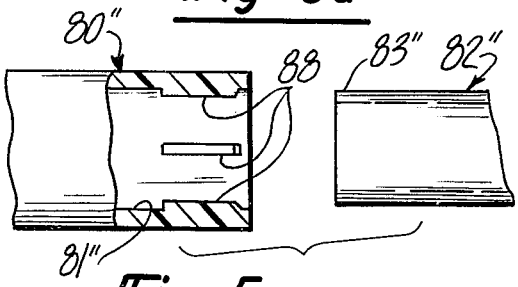

In FIG. 5*c* the internal surface 81" of the light tunnel post 80" contains spaced longitudinal serrations 88 which frictionally engage the external surface 83" of the light tunnel 82" thus increasing the frictional force holding these two parts together. A variety of other connecting means are also available to connect these two parts.

Figure 6:
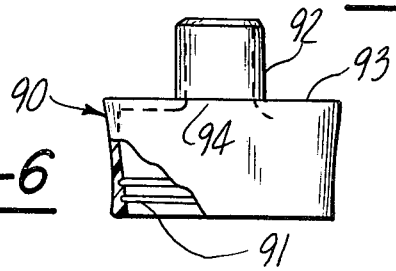
FIG. 6 is a view of a lens cap and light tunnel post molded in one piece.

FIG. 6 shows a lens cap and light tunnel post molded in one piece. In large production quantities this is an advantage because of fewer steps in the process of producing the parts and one less item to be assembled to complete the device. The lens cap post 90 has internal threads 91 which screw into the male threads of the flashlight body. The flange of the light tunnel post is replaced by a necking down of this part at 93. A light tunnel would attach to the post 92 of this device by any one of the means previously described. The light passes from the flashlight bulb or other light source to the opening 94 in the post 92 and into the light tunnel.

Figure 7:
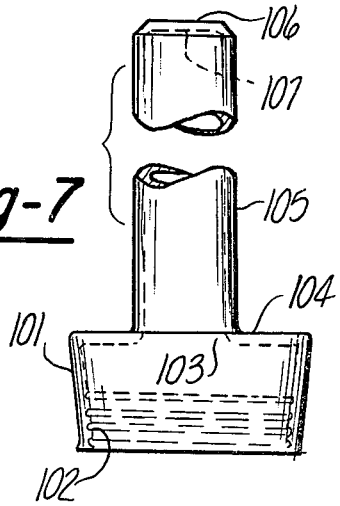
FIG. 7 is a view of a lens cap, a light tunnel post, a light tunnel, and a reflective cap all molded in one piece.

FIG. 7 shows a lens cap, light tunnel post, a light tunnel and the reflective cap all molded in one piece. Because of the requirement that the light tunnel be non-opaque, this part would have to be molded from a non-opaque material. The cap portion 101 has internal female threads 102 which screw on to the light source. The flange of the light tunnel post is again replaced by a necking down 104 to the size of the light tunnel 105. The end of the light tunnel 105 is closed by an integral cap 106 which is molded at the same time and is one piece with the whole assembly. The internal surface 107 of the end portion of the light tunnel is coated with a reflective material. Again this is to enhance the amount of light escaping the device through the walls of the light tunnel. The advantage of this embodiment would be the ease of assembly and the reduction in the number of parts to be assembled.

The embodiments of the invention in which an exclusive property or privilege is claimed are defined as follows:

1. A light emitting device comprising:
a flashlight body;
a light source within said body for producing a beam of light;
a light tunnel further comprising a cylindrical hollow, cylindrical tube of lightweight, relatively flexible plastic having non-opaque walls, fastened at one end to said body such that at least a substantial part of the beam of light emanating from said source is directed into the interior of the tube and along the length thereof; and
a reflecting cap with a reflective inner surface fastened to the other end of said light tunnel to reflect said beam back into the interior of the cylindrical tube;
whereby light from said source is emitted through the walls of said light tunnel.

2. A light emitting device comprising:
a flashlight body;
a light source within said body for producing a beam of light;
adaptor means comprising a lightweight translucent plastic disc of approximately the same diameter as said body and having integrally attached thereto a light tunnel post defining a short hollow tube of a diameter less than the diameter of the body, said adaptor means being attached to the flashlight body such that the beam of light passes through and around the outside of the hollow tube;
a light tunnel including a second hollow plastic tube longer than said post with non-opaque walls removably, telescopically disposed over said post such that light from said source passes into and over the exterior of the second tube; and
a reflective cap with an inner surface, said reflective cap being attached to the end of the light tunnel opposite the light tunnel post; the inner surface of the reflective cap further being reflective to reflect the beam of light back into the interior of the light tunnel.

3. A light emitting device as defined in claim 2 including:
a light tunnel post further comprising a tube with a flange at one end; and,
a lens cap connected by fastening means to said flashlight body, said locking cap further engaging the flange of said light tunnel post and securing it to said light emitting device;

4. A light emitting device as defined in claim 3 including:
a lens cap with female screw threads which engage male screw threads of the light source, as a fastening means.

5. A light emitting device as defined in claim 2 including:
the light tunnel with an inner diameter and inner surface, the light tunnel post with an outer surface and an outer diameter substantially the same as the inner diameter of the light tunnel; so that the inner surface of the light tunnel frictionally fits to the outer surface of the light tunnel post.

6. A light emitting device as defined in claim 5 including:
male screw threads on the external surface of the light tunnel post; and,
female screw threads on the inner surface of the light tunnel which engage the male screw threads of the light tunnel post as attachment means.

7. A light emitting device as defined in claim 5 including:
circumferential grooves on the internal surface of the light tunnel and,
circumferential ridges on the external surface of the light tunnel post,
said circumferential ridges engaging and at least partially filling said circumferential grooves when the light tunnel is attached to the light tunnel post.

8. A light emitting device as defined in claim 5 including:
a plurality of longitudinal serrations parallel to the hollow tube of the light tunnel post spaced about the outer surface of said light tunnel post;
whereby, the frictional force holding the light tunnel to the light tunnel post is increased.

9. A light emitting device as defined in claim 2 including:
the light tunnel with an outer diameter and an outer surface;
the light tunnel post with an inner surface and an inner diameter substantially the same as the outer diameter of the light tunnel;
so that the outer surface of the light tunnel frictionally engages the inner surface of the light tunnel post as the means for attaching.

10. A light emitting device as defined in claim 9 including:
female screw threads on the inner surface of the light tunnel post and;
male screw threads on the outer surface of the light tunnel which engage the female screw threads of the light tunnel post as the attachment means.

11. A light tunnel post as defined in claim 9 including:
a plurality of longitudinal serrations parallel to the hollow tube of the light tunnel spaced about the outer surface of said light tunnel;
whereby, the frictional force holding the light tunnel to the light tunnel post is increased.

12. A light emitting device as defined in claim 2 further comprising:
a light tunnel post with an inner surface with female screw threads on the inner surface at the end attached to the light source and;
a light source with an external surface, with male screw threads on the external surface which engage the female screw threads of the light tunnel post as a means of attaching said light tunnel post to said light source.

13. A light emitting device as defined in claim 2 wherein the light tunnel post is made from a translucent material.

14. A light emitting device as defined in claim 1 wherein:
the inner surface of the reflective cap has a piece of metal foil covering it to increase its reflectivity.

15. A light emitting device as defined in claim 1 wherein:
the inner surface of the reflective cap has a polished surface to increase its reflectivity.

16. A light emitting device as defined in claim 1 wherein:
the reflective cap is plated with a film of highly reflective material to increase its reflectivity.

* * * * *